US012497857B2

(12) United States Patent
Hanson

(10) Patent No.: US 12,497,857 B2
(45) Date of Patent: Dec. 16, 2025

(54) VALVE ASSEMBLY FOR WELLHEAD

(71) Applicant: SPM Oil & Gas Inc., Fort Worth, TX (US)

(72) Inventor: Andrew Hanson, Sherwood Park (CA)

(73) Assignee: SPM Oil & Gas Inc., Fort Worth, TX (US)

( * ) Notice: Subject to any disclaimer, the term of this patent is extended or adjusted under 35 U.S.C. 154(b) by 0 days.

(21) Appl. No.: 18/466,165

(22) Filed: Sep. 13, 2023

(65) Prior Publication Data

US 2025/0084724 A1 Mar. 13, 2025

(51) Int. Cl.
*E21B 34/02* (2006.01)

(52) U.S. Cl.
CPC ..... *E21B 34/02* (2013.01)

(58) Field of Classification Search
CPC ..... E21B 34/02
See application file for complete search history.

(56) References Cited

U.S. PATENT DOCUMENTS 3,435,895 A * 4/1969 Lee ..... E21B 33/072 166/70
10,837,244 B2 11/2020 Su et al.
11,274,511 B2 * 3/2022 Shampine ..... E21B 47/092
11,274,520 B2 3/2022 Martin et al.
11,480,028 B2 10/2022 Beason et al.
11,619,110 B2 4/2023 Pillai et al.
2012/0067594 A1 * 3/2012 Noske ..... E21B 34/063 166/373
2018/0355709 A1 12/2018 Gomez et al.
2019/0010778 A1 * 1/2019 Shampine ..... E21B 47/09
2020/0011168 A1 * 1/2020 Chen ..... G01V 11/002
2020/0048991 A1 * 2/2020 Arteaga ..... E21B 47/06
2020/0308924 A1 * 10/2020 Pitcher ..... E21B 33/072
2022/0316307 A1 10/2022 Curry et al.
2024/0295158 A1 * 9/2024 Mitchell ..... F16K 37/0033

* cited by examiner

*Primary Examiner* — Robert E Fuller

(57) ABSTRACT

A valve assembly for a wellhead includes a channel extending between a first end and a second end; a valve having a valve closed position in which the channel is blocked and a valve open position in which the channel is unblocked; and a flap arrangement having a flap closed position. The flap arrangement is configured to: displace from the flap closed position in an event of obstruction of the channel; and return to the flap closed position on removal of obstruction from the channel. The valve assembly further comprises a sensor, configured to determine an indication of obstruction of the channel by determining whether the flap arrangement is in the flap closed position.

15 Claims, 10 Drawing Sheets

VALVE ASSEMBLY FOR WELLHEAD

TECHNICAL FIELD

The disclosure relates to the field of oil and gas extraction.

BACKGROUND

A well (e.g., an oil well or a gas well) is provided with a wellhead to interface the well with drilling, measurement, and/or extraction equipment. The wellhead may be fitted with a valve for regulating flow within the well. The valve may also be used to control access to the well for tools such as extraction tools, measurement tools, and the like. The tools may be provided with communication cables and/or recovery cables for communicating with and/or recovering the tool. Such tools may access the well by passing through the valve, when open.

It can be difficult to determine whether a valve is obstructed because it is not possible to determine, precisely, the position of each of the various tools and other objects which may be in the wellhead with respect to each of the valves. As such, in many circumstances, it may be difficult to determine whether it is safe to operate the valve because it is not known whether something is obstructing the valve. In some circumstances, users/control systems responsible for operating the tool, and users/control systems responsible for operating the valve may not be in communication with each other. This also makes it difficult to determine whether it is safe to operate the valve because a position of the tool, even if known, may not be communicated to the user/control system for operating the valve.

Closure of one of the valves when the valve is obstructed may lead to damage of the valve and/or damage of anything which is located within the valve as the valve moves to its closed position. Damage to the valve may cause leaks of oil or gas from the well. In addition, if a tool is within the valve as the valve is closing, the tool may become damaged. Communication cables and recovery cables of a tool may be particularly susceptible to damage. If a communication cable or recovery cable is within the valve when the valve is closed, the cable may be severed, causing the tool and a part of the cable to fall into the well. As a result, the tool and the part of the cable may become stuck in the well and require recovery. Recovery of items from the well may be difficult.

SUMMARY

Against this background, there is provided a valve assembly for a wellhead, the valve assembly including a channel extending between a first end and a second end; a valve having a valve closed position in which the channel is blocked and a valve open position in which the channel is unblocked; a flap arrangement having a flap closed position, the flap arrangement being configured to: displace from the flap closed position in an event of obstruction of the channel; and return to the flap closed position on removal of obstruction from the channel; and a sensor, configured to determine an indication of obstruction of the channel by determining whether the flap arrangement is in the flap closed position.

By providing a sensor that determines an indication of obstruction based on whether the flap arrangement is in the flap closed position, it is possible to determine with improved reliability whether the valve is obstructed. As such, the likelihood of moving the valve to the valve closed position when the valve is obstructed is reduced. This reduces the risk of damage to the valve, which reduces the risk of an oil or gas leak. It also reduces the risk of damage to whatever may be obstructing the valve, which in turn reduces the risk that, for example, a tool will become severed and fall into the well.

BRIEF DESCRIPTION OF THE DRAWINGS

A specific embodiment of the disclosure will now be described, by way of example only, with reference to the accompanying drawings in which.

DETAILED DESCRIPTION

Figure 1:
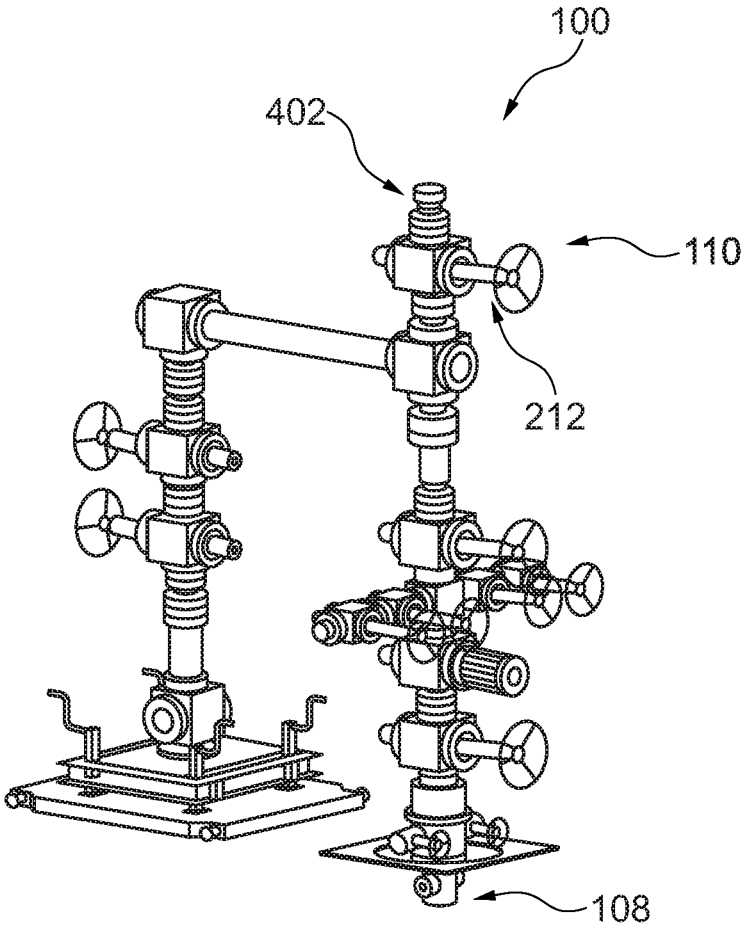
FIG. 1 shows an example of a wellhead.

According to an embodiment of this disclosure, there is provided a valve assembly for a wellhead. The valve assembly includes a channel, a valve, a flap arrangement, and a sensor. By determining if the flap arrangement has been displaced from a flap closed position, the sensor can determine an indication of obstruction of the channel. Based on the indication of obstruction, operation of the valve in an event of obstruction can be avoided.

The channel extends between a first end and a second end of the valve assembly. The valve has a valve closed position in which the channel is blocked and a valve open position in which the channel is unblocked. The flap arrangement is displaced from the flap closed position in an event of obstruction of the channel and returns to the flap closed position on removal of obstruction of the channel. As such, displacement of the flap arrangement from the flap closed position may be used to determine if the channel is obstructed. The sensor is configured to determine if the flap arrangement is displaced from the flap closed position. Based on whether the flap arrangement is displaced from the flap closed position, the sensor can determine an indication of obstruction of the channel. This is useful because, if the indication of obstruction shows the channel is obstructed, operation of the valve may be avoided.

The valve assembly may further comprise a valve actuation assembly configured to actuate the valve between the valve open and valve closed position. In some embodiments, the valve actuation assembly may be prevented from actuating the valve in response to the indication of obstruction if the indication of obstruction is set to indicate that the channel is obstructed.

The channel may be obstructed by a tool. The tool may comprise a tool end and cabling, the cabling being provided for one or more of communicating with the tool end and/or recovering the tool end. With the tool in use, a sub-section of the tool may extend between the first end and the second end of the channel. Examples of tools may include wireline and/or sandline. Moving the valve assembly to the valve closed position when the channel is obstructed by the tool may cause damage to the valve and/or the tool. For example, the cabling may be severed by moving the valve to the valve closed position. How this can be avoided by embodiments of the present disclosure will now be explained.

With the tool not in use, the channel would not be obstructed by the tool, and the flap arrangement would be in the flap closed position. Based on the flap arrangement being in the flap closed position, the indication of obstruction may be set to indicate that the channel is not obstructed.

If the tool is introduced into the channel, for example by passing the tool through the channel between the first end and the second end, the channel may become obstructed by the tool, and the flap arrangement would be displaced from the flap closed position. Based on the flap arrangement being displaced from the flap closed position, the indication of obstruction may be set to indicate that the channel is obstructed.

If the tool remains present in the channel, the channel may continue to be obstructed by the tool, and the flap arrangement may continue to be displaced from the flap closed position. Based on the flap arrangement being displaced from the flap closed position, the indication of obstruction may be set to indicate that the channel is obstructed.

If the tool is removed from the channel, the channel would not be obstructed by the tool, and the flap arrangement may return to the flap closed position. Based on the flap arrangement being in the flap closed position, the indication of obstruction may be set to indicate that the channel is not obstructed.

In this way, the determinations by the sensor based on the displacement of the flap arrangement may be used to indicate whether the channel is obstructed. As such, it is possible to use the indication of obstruction to avoid operating the valve when the channel is obstructed. Any obstruction may be detected provided the obstruction displaces the flap arrangement from the closed position.

FIG. 1 shows an example of a wellhead 100 which is useful for understanding this disclosure. In use, the wellhead 100 may be connected to a well (not shown) at a well connecting end 108. Flows of oil or gas may enter the wellhead 100 at the well connecting end 108. The wellhead 100 includes a valve assembly 110 which is used to regulate flows withing the wellhead 100. It is noted that the valve assembly 110 is used for the purpose of understanding the disclosure, but any other valve assemblies suitable for use in a wellhead could be used, such as the other valve assemblies shown in FIG. 1 (not labelled).

The valve assembly 110 includes a first end of the valve assembly 402 which may be configured to permit entry of a tool (the tool is not shown in FIG. 1) into the wellhead 100. In some embodiments, the first end of the valve assembly 402 may be connectable to one or other more pipes and/or valves. The valve assembly 110 includes a valve actuation assembly 212 configured to actuate the valve between a valve open and valve closed position. With the valve assembly 110 in the valve open position, the tool may be introduced into the valve assembly 110 (and by doing so be introduced into the wellhead 100) through the first end 402. Then, the tool may pass through the wellhead 100 and into the well.

Figure 2:
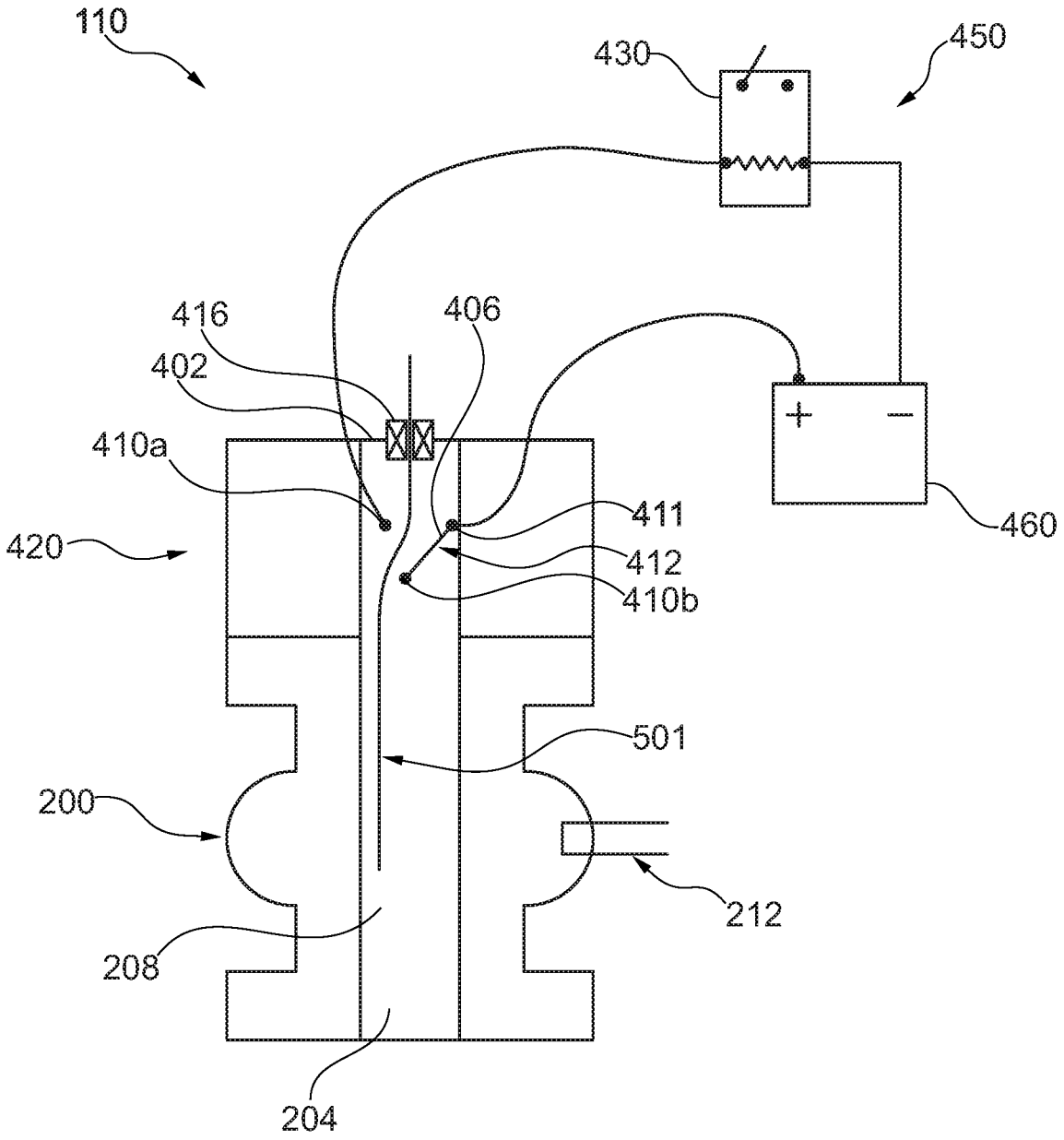
FIG. 2 shows a valve assembly with a flap arrangement displaced from a flap closed position.

An example of the valve assembly 110 according to an embodiment of this disclosure is shown in FIG. 2. FIG. 2 shows the valve assembly 110 with the flap arrangement 412 displaced from the flap closed position. For the purpose of simplifying other Figures, the section of FIG. 2 indicated by reference number 420 is henceforth referred to as a flap section, and the section of FIG. 2 indicated by reference number 200 is henceforth referred to as a valve section. In other Figures, only the flap section 420, or only the valve section 200 may be shown. In some embodiments, as in FIG. 2, the flap section 420 may comprise the flap arrangement 412, and the valve section 200 may comprise a valve.

The valve assembly 110 further comprises a sensor, which in some embodiments comprises an electrical circuit 450, e.g. as shown in FIG. 2. The flap arrangement 412 may comprise a flap 406 and a hinge 411 configured to allow the flap 406 to rotate about the hinge 411. The flap arrangement 412 may comprise a conducting portion. For example, the electrical circuit 450 may comprise a power supply 460, such as a DC power supply, and the conducting portion of the flap arrangement.

Figure 3:
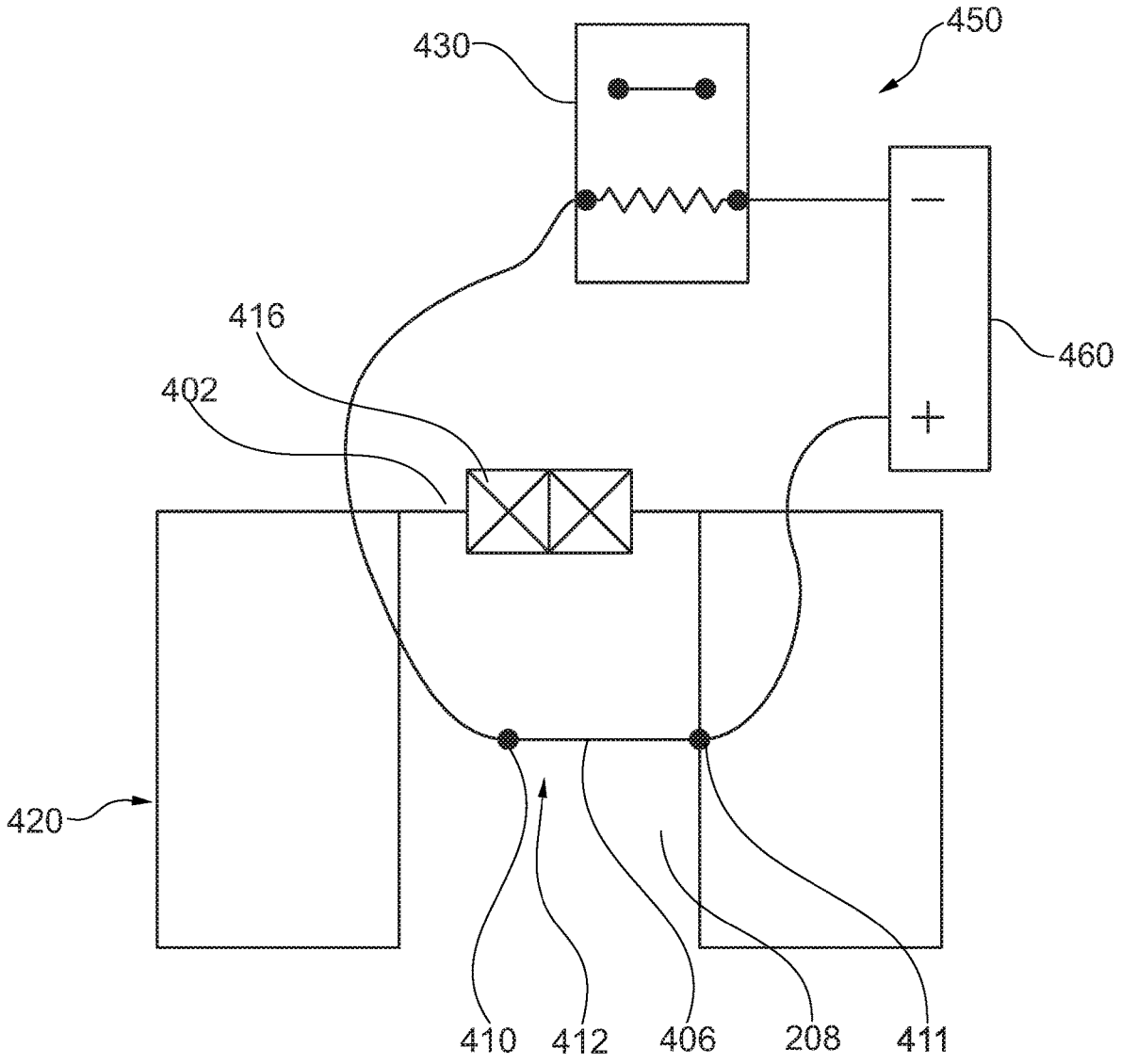
FIG. 3 shows a flap section of the valve assembly with the flap arrangement in the flap closed position, and a sensor comprising an electrical circuit.

The conducting portion of the flap arrangement may be configured such that, in the flap closed position, the conducting portion of the flap arrangement completes the electrical circuit 450. FIG. 3 shows the flap arrangement 412 in the flap closed position. The conducting portion of the flap arrangement may also be configured such that, if the flap 406 is displaced from the flap closed position, the electrical circuit 450 is broken. The flap 406 may be displaced from the flap closed position (as shown in FIG. 3) by rotating the flap 406 about the hinge 411. FIG. 2 shows the flap arrangement 412 displaced from the flap closed position, such that the electrical circuit 450 is broken. With the flap 406 displaced from the flap closed position, electrical connection 410 is broken into a first terminal 410*a*, and a second terminal 410*b*. If displaced from the flap closed position, the conducting portion of the flap may be electrically isolated from the first terminal 410*a* but may be electrically connected to the second terminal 410*b*. If in the flap closed position, the first terminal 410*a*, the second terminal 410*b*, and the conducting portion of the flap may be electrically connected.

Therefore, if the flap arrangement 412 is displaced from the flap closed position, the electrical circuit 450 may be broken, meaning no current may flow in the electrical circuit 450. If the flap arrangement is in the flap closed position, the electrical circuit 450 is complete meaning a current may flow in the electrical circuit 450.

The flap arrangement 412 may be biased to the flap closed position by a biasing element, such as a spring. For example, the hinge 411 may comprise the biasing element. As such, if the flap arrangement 412 is displaced from the flap closed position in the event of obstruction, the biasing element causes the flap arrangement 412 to return to the flap closed position once the obstruction is removed.

FIG. 2 shows a tool 501 in channel 208 of the valve assembly 110. The tool 501 may be introduced into the channel 208 at the first end 402. The first end 402 may comprise tool adaptor 416 configured to control lowering of the tool 501 into the channel 208 and/or control withdrawal of the tool 501 from the channel 208. As the tool 501 is lowered into the channel 208, a distal end (e.g., downward end) of the tool causes the flap arrangement 412 to be displaced from the flap closed position.

FIG. 3 shows the flap section 420 without the tool 501 in the channel 208. Because there is no tool 501 in the channel 208 (e.g., because the tool 501 has not been introduced and/or because the tool 501 has been removed), the flap 406 is in the flap closed position.

In some embodiments, the flap arrangement 412 has a total cross-sectional area which covers an entire cross section of the channel 208 when the flap arrangement 412 is in the flap closed position. As such, if the tool 501 is moved between the first end 402 and second end 204, the tool 501 must displace the flap 406 from the flap closed position in order to move through the channel 208.

The sensor may determine whether the flap arrangement 412 is in the flap closed position based on the current flow in the electrical circuit 450. In an event that current flow is detected, the indication of obstruction may be set to indicate that the channel 208 is not obstructed. In an event that current flow is not detected, the indication of obstruction may be set to indicate that the channel 208 is obstructed.

To detect the current flow, the sensor may comprise an electrical sensor such as a current sensor, a voltage sensor, a resistance sensor and/or the like configured to determine an electrical parameter such as a current value, a voltage value, a resistance value, and/or the like. The electrical parameter may depend on whether the electrical circuit 450 is broken. For example, the current value may be determined by a current sensor to be zero in an event that the electrical circuit 450 is broken and to be non-zero in an even that the electrical circuit 450 is connected.

In some embodiments, as shown in FIGS. 2-3, the electrical circuit 450 may comprise a relay 430. The relay 430 may be connected to a warning indicator (not shown), comprising one or more of an alarm, a light, and/or a signal. With the electrical circuit 450 connected, the relay 430 may be in an unpowered state. With the electrical circuit 450 broken, the relay 430 may be in a powered state. As such, if the electrical circuit 450 is broken, the relay 430 is in the powered state, which switches on the warning indicator. If the electrical circuit 450 is connected, the relay 430 is in the unpowered state, which switches off the warning indicator.

Figure 4:
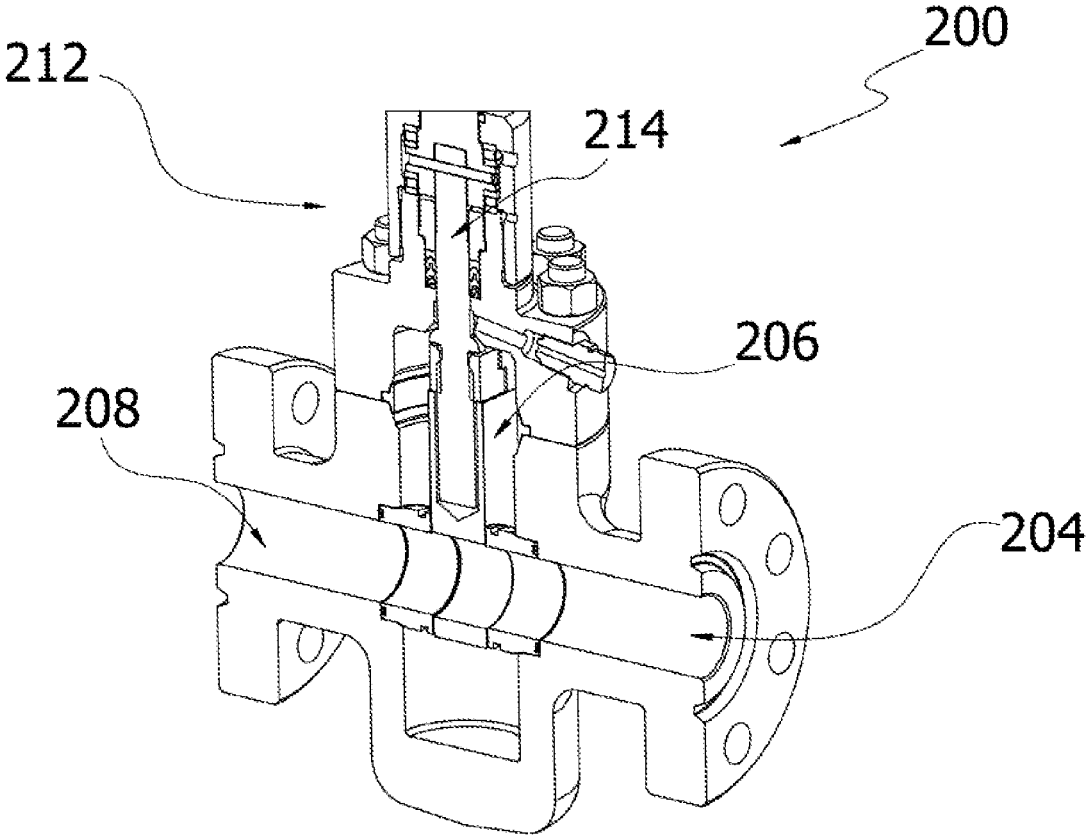
FIG. 4 shows a valve section of the valve assembly in a valve open position.

FIG. 4 shows the valve section 200 of the valve assembly 110 in the valve open position. As can be seen from FIG. 4, in the valve open position, the channel 208 is unblocked. Because the channel 208 is unblocked, it is possible, in the valve open position, for the tool 501 to pass along and/or be located along the channel 208.

Figure 5:
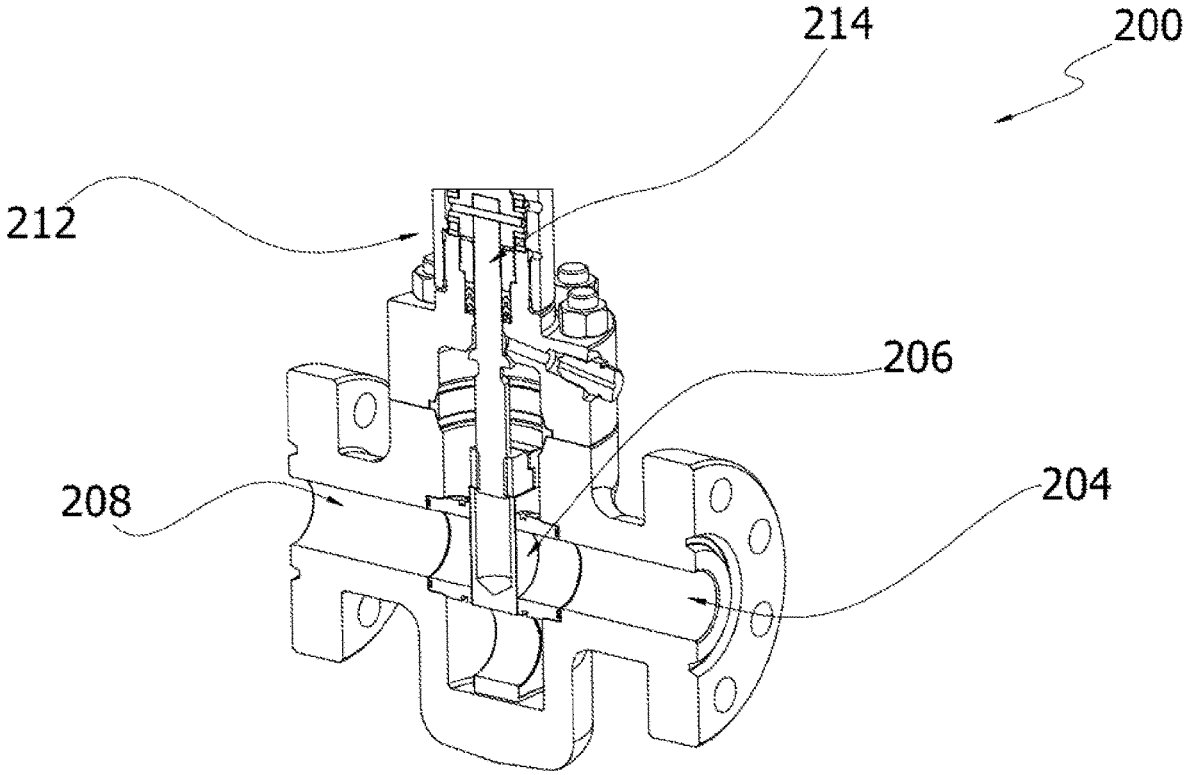
FIG. 5 shows the valve section of the valve assembly in a valve closed position.

FIG. 5 shows a three-dimensional cross section of the valve section 200 of the valve assembly 110 in the valve closed position. In the valve closed position, the channel 208 is blocked. Because the channel 208 is blocked, it is not possible, in the valve closed position, for the tool to pass along and/or be located along the channel 208.

The valve assembly may further comprise a valve actuation assembly 212 configured to actuate the valve between the valve open and valve closed position. As shown in FIG. 4, the valve section 200 further comprises valve actuation assembly 212. The valve actuation assembly 212 comprises a valve blocking element 206 (e.g., a gate) and a valve actuator 214. The valve actuator 214 can be used to slide the valve blocking element 206 into the channel 208 such that the valve blocking element 206 blocks the channel 208. For example, the valve actuation assembly 212 may comprise a handle as shown in FIG. 1, such that as the handle is rotated, the valve actuator 214 causes the valve blocking element 206 to slide from outside the channel 208 (as shown in FIG. 4) to inside the channel (as shown in FIG. 5). Alternatively, or additionally, the valve actuation assembly 212 may comprise one or more linear actuators, such as an electromechanical actuator for controlling actuation of the valve blocking element 206 electronically.

Figure 6:
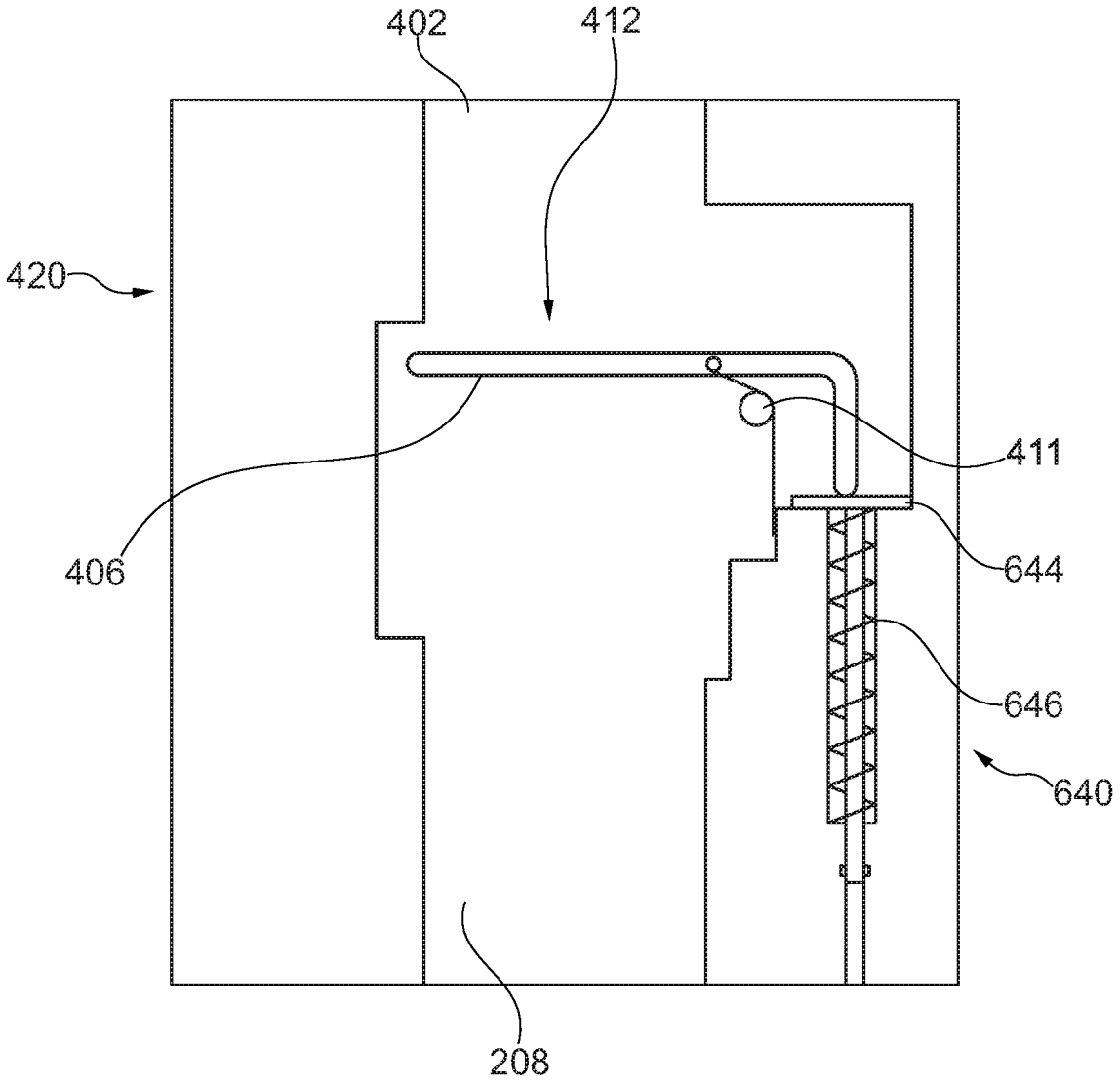
FIG. 6 shows the flap section and a sensor comprising a linear variable differential transformer.
Figure 7:
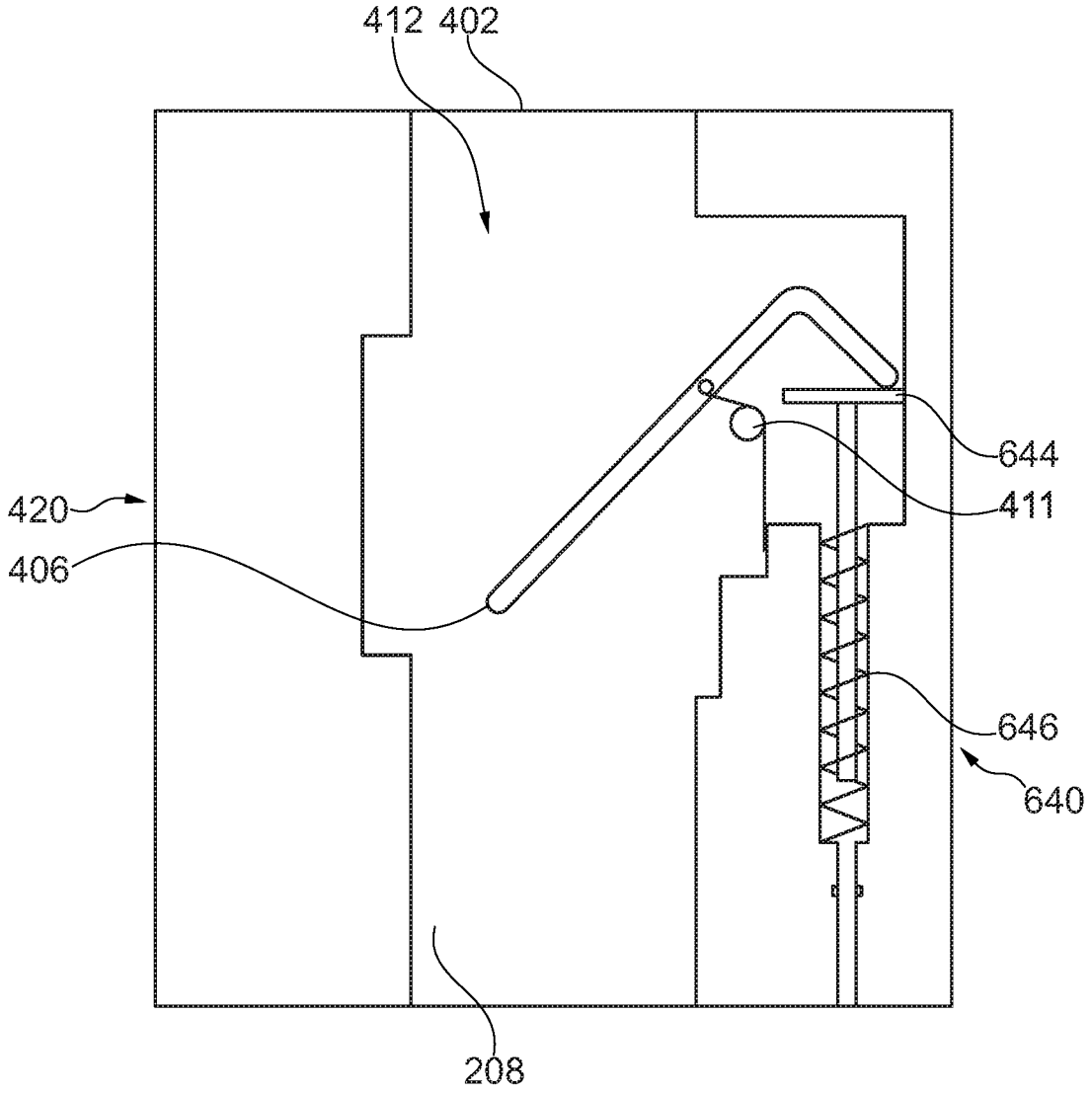
FIG. 7 shows the flap section of FIG. 6 displaced from the flap closed position.
Figure 8:
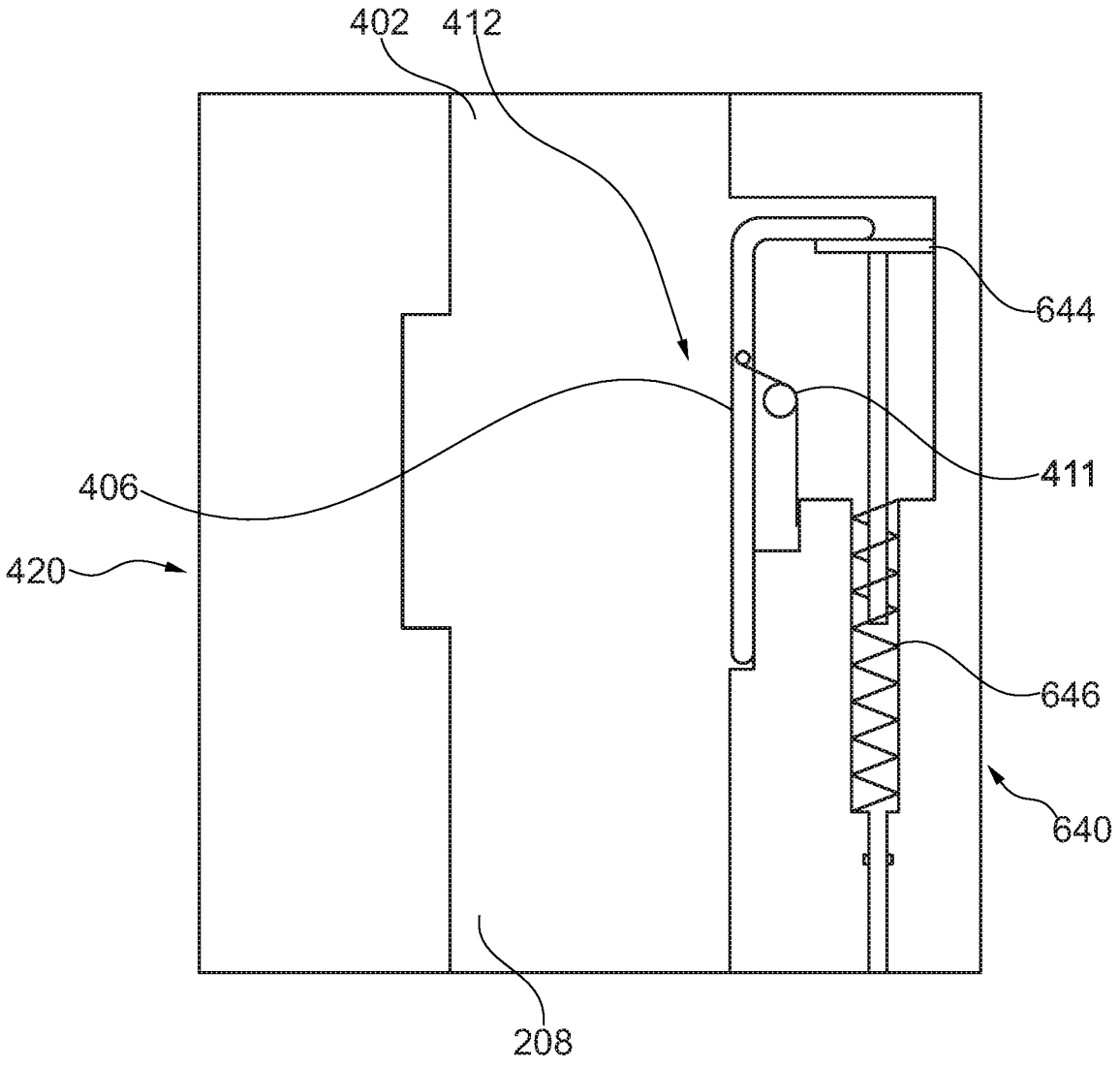
FIG. 8 shows the flap arrangement of FIGS. 6 and 7 fully displaced from the flap closed position.

FIGS. 6 to 8 shows the flap section 420 in an embodiment where the sensor comprises a linear variable differential transformer 640.

The sensor may comprise the linear variable differential transformer either instead of or in addition to the electrical circuit 450 described above. The linear variable differential transformer may be configured to measure the displacement of the flap 406 from the flap closed position. The sensor may be configured to determine whether the flap arrangement 412 is in the flap closed position based on the displacement of the flap 406 from the flap closed position. Embodiments of the valve assembly 110, wherein the sensor comprises the linear variable differential transformer will now be explained with reference to FIGS. 6 to 8.

The linear variable differential transformer 640 may be configured to be linearly displaced as the flap arrangement 412 is displaced from the flap closed position. The linear variable differential transformer 640 may comprise a housing 646, and a rod 644. The rod 644 may be configured to extend and retract from the housing 646. Thus, linear displacement of the linear variable differential transformer 640 may comprise an extension or a retraction of the rod 644. When retracted into the housing 646, the rod 644 may be in the rod retracted position. The housing 646 may comprise a biasing element, such a spring, configured to bias the rod 644 to the rod retracted position if no external force is applied to the rod 644. The linear variable differential transformer 640 may be configured to output an electrical signal, the electrical signal being indicative of a linear displacement of the linear variable differential transformer 640.

The linear variable differential transformer 640 may be configured to be linearly displaced as the flap arrangement 412 is displaced from the flap closed position. FIG. 6 shows the flap arrangement 412 in the flap closed position and the sensor comprising a linear variable differential transformer 640. The linear variable differential transformer 640 may be associated with the flap 406. The rod 644 is connected to the flap arrangement 412 such that as the flap arrangement is displaced from the flap closed position, the rod 644 is linearly displaced. For example, the rod 644 may be connected to the flap 406 such that as the flap 406 is rotated about the hinge 411, the rod 644 is linearly displaced from a rod retracted position. In FIG. 6, the rod 644 is shown in the rod retracted position.

FIG. 7 shows the flap arrangement 412 of FIG. 6 displaced from the flap closed position. Compared with FIG. 6, in FIG. 7, the flap 406 is rotated about the hinge 411 and the rod 644 is linearly displaced from the rod retracted position.

FIG. 8 shows the flap arrangement 412 of FIGS. 6 and 7, displaced from the flap closed position. Compared with FIG. 7, in FIG. 8 the flap 406 is rotated about the hinge 411 further from flap closed position, and the rod 644 is linearly displaced further from the rod retracted position.

An extension or retraction of the rod 644 may correspond directly with a rotation of the flap 406 about the hinge 411, such that a measurement of the linear displacement of the rod 644 may be used to measure the rotation of the flap 406 about the hinge 411.

The displacement of the flap 406 from the flap closed position may be based on the electrical signal. The electrical signal may be output by the linear variable differential transformer 640, the electrical signal being indicative of the linear displacement of the rod 644 from the rod retracted position. The linear variable differential transformer 640 may comprise a primary coil and two secondary coils. The primary coil may be configured to induce a voltage in each secondary coil. The primary coil may be powered by an AC power supply and configured to induce an alternating voltage in each secondary coil. The electrical signal may comprise a voltage difference between the secondary coils. As the rod 644 is linearly displaced, the primary coil is displaced with respect to each secondary coil. Because the voltage induced in each secondary coil depends on its distance from the primary coil, the voltage in each secondary coil depends on the displacement of the primary coil, which in turn depends on the linear displacement of the rod 644. The voltage difference between the secondary coils may be used to indicate the linear displacement of the rod 644.

The electrical signal may be proportional to the linear displacement of the rod 644 from the rod retracted position. An increase in the electrical signal may indicate that the rod 644 has been linearly displaced from the rod retracted position, while a decrease in the electrical signal may indicate that the rod 644 has been linearly displaced towards the rod retracted position. Because the rod 644 is connected to the flap 406, the electrical signal may also indicate the displacement of the flap arrangement 412 from the flap closed position.

The sensor is configured to determine the indication of obstruction based on whether the flap arrangement 412 is in the flap closed position, which if the sensor comprises the linear variable differential transformer 640, may be based on the electrical signal. If the electrical signal is above a threshold electrical signal, the indication of obstruction may be set to indicate that the channel may be obstructed. If the electrical signal is below the threshold electrical signal, the indication of obstruction may be set to indicate that the channel may not be obstructed.

In some embodiments, more than one linear variable differential transformer 640 may be associated with the flap 406, for example to provide back up linear variable differential transformers in an event that one of the linear variable differential transformers is inactivated.

Figure 9:
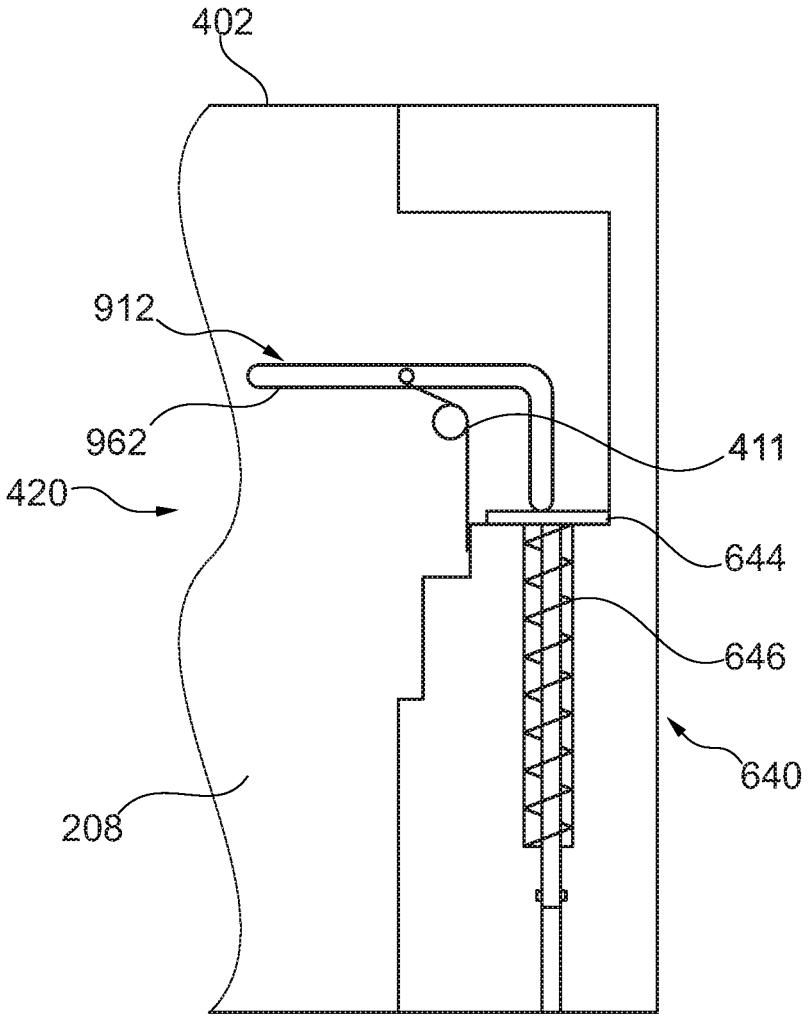
FIG. 9 shows a first flap of a flap arrangement having more than one flap, with the first flap in the flap closed position.

In some embodiments, the flap arrangement may comprise more than one flap. In embodiments where the flap arrangement comprises more than one flap, the valve assembly 110 may be configured similarly to the embodiments described above in detail for a single flap. FIG. 9 shows a first flap 962 of a flap arrangement 912 having more than one flap, where the first flap 962 is in a first flap closed position. Only a portion of the flap section 420 is shown in FIG. 9. For example, the flap arrangement 912 may include one or more additional flaps that have a similar arrangement to the first flap 962 (e.g., being a mirror image thereof).

Figure 10:
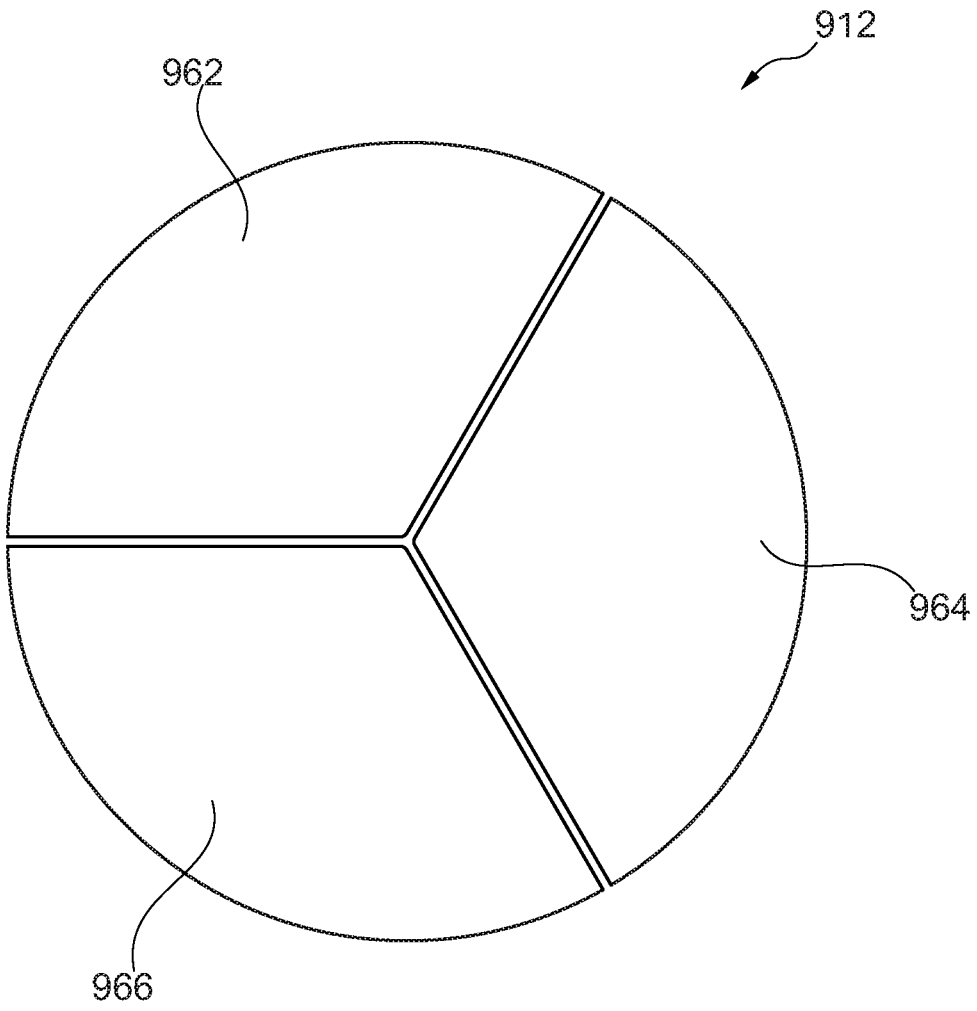
FIG. 10 shows a flap arrangement comprising three flaps.

FIG. 10 shows a flap arrangement 912 comprising three flaps 962, 964, 966. The view in FIG. 10 may be the flap arrangement 912 as viewed from the first end 402. As seen in FIG. 10, the flap arrangement 912 may comprise the first flap 962, a second flap 964, and a third flap 966. Each flap 962, 964, 966 may have a respective flap closed position such that the flap arrangement 912 is in the flap closed position only if all of the three flaps 962, 964, 966 are in respective flap closed positions. While each flap 962, 964, 966 may not individually cover the entire cross section of the channel 208, if the flap arrangement 912 is in the flap closed position, the flaps together may cover the entire cross section of the channel 208.

In embodiments where the sensor comprises the electrical circuit 450, each flap 962, 964, 966 may comprise a conducting portion. For example, the first flap 962 may comprise a conducting portion of the first flap, the second flap 964 may comprise a conducting portion of the second flap, and the third flap 966 may comprise a conducting portion of the third flap. The conducting portion(s) of each flap, if the flap arrangement 912 is in the closed position, may together form the conducting portion of the flap arrangement. If any one of the flaps 962, 964, 966 is displaced from the respective flap closed position, the electrical circuit 450 may be broken.

In some embodiments the sensor may comprise more than one linear variable differential transformer. Each linear variable differential transformer 640 may be associated with one of the flaps 962, 964, 966. The sensor may be configured to determine whether the flap arrangement 912 is in the flap closed position based on an electrical signal from each linear variable differential transformer 640. If any of the flaps is displaced from the respective flap closed position, the indication of obstruction may be set to indicate the channel is obstructed. If the electrical signal from any of the linear variable differential transformers 640 is above a threshold electrical signal, the indication of obstruction may be set to indicate that the channel is obstructed. If the electrical signal is below the threshold electrical signal for each of the linear variable differential transformers 640, the indication of obstruction may be set to indicate that the channel is not obstructed.

In some embodiments, the valve assembly 110 may comprise a signal output device. The signal output device may comprise a data output terminal configured to output the indication of obstruction. In some embodiments, using the data output terminal, the sensor may output the indication of obstruction to a warning indicator comprising one or more of an alarm, a light, and/or a signal. The signal output device may output the indication of obstruction using the data output terminal to the warning indicator. The warning indicator may be activated in response to the indication of obstruction. For example, the warning indicator may be activated if the indication of obstruction is set to indicate that the channel is obstructed.

In some embodiments, using the data output terminal, the sensor may output the indication of obstruction to an interlock. The interlock may, if in an interlock activated state, be configured to prevent actuation of the valve. In the interlock activated state, the interlock may prevent actuation of the valve between the valve open position and the valve closed position. The interlock may prevent actuation of the valve by one or more (i) mechanically blocking or preventing movement of a valve actuator or (ii) electrically inactivating an electromechanical actuator. The interlock may be set to the interlock activated state in response to the indication of obstruction. For example, the interlock may be set to the interlock activated state if the indication of obstruction is set to indicate that the channel is obstructed.

In some embodiments, the valve assembly 110 may comprise a lubricant injector configured to displace debris (e.g. sand from the well) from the valve assembly 110. Debris may prevent the flap assembly from returning the flap closed position. As such, if sand is present, the indication of obstruction may be set to indicate that the channel 208 is obstructed. Thus, if sand is present, it may not be possible to determine, based on the indication of obstruction, if the tool 501 is in the channel 208. The lubricant injector may be used to inject lubricant into the valve assembly 110 to displace the debris. Following the lubricant injection, if the flap assembly 412, 912 returns to the flap closed position, the indication of obstruction may be set to indicate that the channel 208 is not obstructed. Following the lubricant injection, if the flap assembly 412, 912 does not return to the flap closed position, the indication of obstruction may be set to indicate that the channel 208 is obstructed.

In some embodiments, the flap arrangement 412, 912 may become damaged, for example by the debris, in such a way that the flap arrangement 412, 912 becomes obstructive to the channel 208. If the flap arrangement 412, 912 becomes damaged, it may be desirable to remove the flap arrangement 412, 912 from the channel 208 to prevent obstruction of the channel 208 and/or to repair the flap arrangement 412, 912. Therefore, in some embodiments, the valve assembly 110 may further comprises a mechanical override system to withdraw the flap arrangement 412, 912 from the channel 208.

INDUSTRIAL APPLICABILITY

In the field of oil and gas extraction, there is a need for systems and methods that enable operators to avoid closing a valve onto a tool or other object. Embodiments of the present disclosure provide a system that determines an indication of obstruction based on whether the flap arrangement is in the flap closed position. As such, the likelihood of moving the valve to the valve closed position when the valve is obstructed is reduced. This reduces the risk of damage to the valve, which reduces the risk of an oil or gas leak. It also reduces the risk of damage to whatever may be obstructing the valve, which in turn reduces the risk that, for example, a tool will become severed and fall into the well.

What is claimed is:

1. A valve assembly for a wellhead, the valve assembly comprising:

a channel extending between a first end and a second end;

a valve having a valve closed position in which the channel is blocked and a valve open position in which the channel is unblocked;

a flap arrangement having a flap closed position, the flap arrangement being configured to:

displace from the flap closed position toward the valve continuously during obstruction of the channel by a tool on a cable; and return to the flap closed position on removal of obstruction from the channel, wherein the flap arrangement has a total cross-sectional area that covers an entire cross section of the channel when the flap arrangement is in the flap closed position; and a sensor, configured to determine an indication of obstruction of the channel by determining whether the flap arrangement is in the flap closed position.

2. The valve assembly of claim 1, further comprising a biasing element, wherein:

the flap arrangement is biased to the flap closed position by the biasing element.

3. The valve assembly of claim 1, wherein:

in an event that the sensor determines that the flap arrangement is not in the flap closed position, the indication of obstruction of the channel is set to indicate that the channel is obstructed; and the sensor outputs the indication of obstruction of the channel.

4. The valve assembly of claim 3, wherein the sensor outputs the indication of obstruction of the channel to a warning indicator comprising one or more of:

an alarm;

a light;

or a signal, wherein the warning indicator is activated based on the indication of obstruction from the sensor.

5. The valve assembly of claim 3, further comprising:

a valve actuation assembly configured to actuate the valve between the valve open position and the valve closed position, wherein the valve actuation assembly is prevented from actuating the valve based on the indication of obstruction of the channel being set to indicate that the channel is obstructed.

6. The valve assembly of claim 5, further comprising:

an override switch of the valve actuation assembly that, when activated, allows the valve actuation assembly to actuate the valve, when the indication of obstruction is set to indicate that the channel is obstructed.

7. The valve assembly of claim 1, wherein:

the flap arrangement comprises one or more flaps, where each of the one or more flaps has a respective flap closed position;

the sensor is configured to determine the indication of obstruction in the channel by determining whether each of the one or more flaps is in the respective flap closed position; and if the sensor determines that one or more of the one or more flaps is not in the respective flap closed position, the indication of the obstruction is set to indicate that the channel is obstructed.

8. The valve assembly of claim 7, wherein, the sensor comprises an electrical circuit arranged such that, in the respective flap closed position, each of the one or more flaps completes the electrical circuit; and if any one of the one or more flaps is displaced from the respective flap closed position, the electrical circuit is broken, and the sensor is configured to determine whether the flap arrangement is in the flap closed position based on the electrical circuit being broken.

9. The valve assembly of claim 7, wherein:

the sensor comprises one or more linear variable differential transformers configured to measure the displacement of each of the one or more flaps from the respective flap closed position; and the sensor is configured to determine whether the flap arrangement is in the flap closed position based on the displacement of each of the one or more flaps from the respective flap closed position.

10. The valve assembly of claim 9, wherein the one or more linear variable differential transformers comprise multiple linear variable differential transformers and the one or more flaps comprise multiple flaps, and wherein:

each of the one or more linear variable differential transformers is associated with a respective flap of the one or more flaps;

each of the one or more linear variable differential transformers outputs an electrical signal, the electrical signal being indicative of a linear displacement of the respective linear variable differential transformer; and the displacement of each of the one or more flaps from the respective flap closed position is based on the electrical signal.

11. The valve assembly of claim 1, further comprising a mechanical override system configured to withdraw the flap arrangement from the channel.

12. A valve assembly for a wellhead, the valve assembly comprising:

a channel extending between a first end and a second end;

a valve having a valve closed position in which the channel is blocked and a valve open position in which the channel is unblocked;

a flap arrangement having a flap closed position, the flap arrangement being configured to:

displace from the flap closed position toward the valve continuously when the channel is obstructed by a cable; and return to the flap closed position when the channel is not obstructed, wherein the flap arrangement has a total cross-sectional area that covers an entire cross section of the channel when the flap arrangement is in the flap closed position; and a sensor configured to:

obtain information related to a position of the flap arrangement;

detect, based on the information, whether the flap arrangement is in the flap closed position; and at least one of:

determine, when the flap arrangement is detected in the flap closed position, that the channel is not obstructed, or determine, when the flap arrangement is not detected in the flap closed position, that the channel is obstructed.

13. The valve assembly of claim 12, further comprising:

a valve actuation assembly configured to actuate the valve between the valve open position and the valve closed position, wherein the channel is determined to be obstructed, and wherein, when the channel is determined to be obstructed, the valve actuation assembly is prevented from actuating the valve.

14. The valve assembly of claim 12, further comprising:

a valve actuation assembly configured to actuate the valve between the valve open position and the valve closed position, wherein the channel is determined to be not obstructed, and wherein, when the channel is determined to be not obstructed, the valve actuation assembly is allowed to actuate the valve.

15. The valve assembly of claim 12, wherein the sensor includes one or more linear variable differential transformers.

* * * * *